United States Patent [19]

Morris

[11] Patent Number: 4,899,513

[45] Date of Patent: Feb. 13, 1990

[54] ANCHOR FOR SIMULATED MARBLE PANELS

[76] Inventor: Phillip L. Morris, 15 Ridgewood Dr., Hockessin, Del. 19707

[21] Appl. No.: 301,393

[22] Filed: Jan. 25, 1989

[51] Int. Cl.[4] ..... E04B 1/41; E04C 2/02

[52] U.S. Cl. ..... 52/511; 52/506; 248/205.3

[58] Field of Search ..... 248/205.3; 52/391, 366, 52/506, 511, 512, 743, 746, 744

[56] References Cited

U.S. PATENT DOCUMENTS

| | | | |
|---|---|---|---|
| 1,971,396 | 8/1934 | Waide | 248/205.3 |
| 2,151,597 | 3/1939 | Hamilton | 52/391 |
| 2,195,905 | 4/1940 | Stemley | 52/511 |
| 2,365,629 | 12/1944 | Eckel | 52/506 |
| 2,793,887 | 5/1957 | Moore | 248/205.3 |
| 3,147,832 | 9/1964 | Saro | 52/506 |
| 3,246,439 | 4/1966 | Foster, Jr. et al. | 248/205.3 |
| 3,349,530 | 10/1967 | Zigler | 52/512 |
| 3,350,832 | 11/1967 | Persson | 52/506 |
| 3,910,539 | 10/1975 | Cutler | 248/205.3 |
| 3,950,908 | 4/1976 | Van Eyk | 52/506 |
| 4,724,638 | 2/1988 | Bezborodko | 52/511 |

*Primary Examiner*—Carl D. Friedman
*Assistant Examiner*—Caroline D. Dennison
*Attorney, Agent, or Firm*—Connolly and Hutz

[57] ABSTRACT

Simulated marble panels are mounted in place by an anchor which includes an elongated pin having a pointed remote end with an anchor plate secured to its opposite base end. The anchor plate has a plurality of perforations extending completely through it so that it may be positioned in a recess in the panel and permanently mounted to the panel by means of a bonding agent applied to the recess which flows through the perforations in the anchor plate and covers the anchor plate when it forms an integral bond with the panel. The pin may then be secured to a substrate in any suitable manner.

10 Claims, 1 Drawing Sheet

ANCHOR FOR SIMULATED MARBLE PANELS

BACKGROUND OF INVENTION

A popular panel material is simulated marble, particularly such simulated marble marketed by the DuPont Company under the trademark CORIAN®. While this simulated marble material is highly attractive, because of the nature of the material it is difficult to mount panels of the material to walls and other support surfaces without using some attaching means that detract from its attractiveness particularly where the support surface is a metal structural substrate. For example, conventional practices require the use of edge molding materials to facilitate mounting the panels or require using fasteners which must extend completely through the panels but which are unsightly. Because of the mounting difficulties, the prior art had not made full use of the aesthetic nature and of the demand by consumers for such simulated marble panels.

U.S. Pat. No. 3,910,539 discloses an anchor device for insulation material, but not for CORIAN® panels. U.S. Pat. Nos. 1,971,396; 2,793,887 and 3,246,439 also disclose anchor devices.

SUMMARY OF INVENTION

An object of this invention is to provide an anchor member which is capable of mounting simulated marble panels without causing any unsightly modifications to the panels such as molding strips or holes in the panels.

A further object of this invention is to provide such an anchor member which may be securely fastened to a panel and in turn also securely fastened to a structural substrate.

In accordance with this invention, the anchor member is in the form an elongated pin having a point at one end and a base at the other end. An anchor plate is secured to the base end of the pin. The anchor plate has a plurality of holes or perforations extending completely therethrough so that the anchor plate may be inserted into a recess in a simulated marble panel. The recess may then be filled with a bonding agent which flows into the holes in the anchor plate and also covers the anchor plate to permanently mount the anchor plate and the pin to the panel when the bonding agent becomes integrally joined to the panel. The anchor plate thereby becomes embedded in the panel. The exposed portion of the pin may then be utilized to mount the panel to a fixed support, such as a metal structural substrate.

In a preferred practice of this invention a lock or retainer plate is slidably mounted in a one-way direction on the pin for pressing against the substrate from behind which would be sandwiched between the retainer plate and the embedded anchor plate.

THE DRAWINGS

DETAILED DESCRIPTION

The present invention is specifically intended to provide an anchor member which may be used for mounting a simulated marble article, particularly one of a type marketed by the DuPont Company under the trademark CORIAN®. Such a simulated marble article is disclosed in greater detail in U.S. Pat. No. 3,847,865 which relates to the composition of the simulated marble article, namely, alumina trihydrate in a polymethyl methacrylate. The details of that patent are incorporated herein by reference thereto. Such simulated marble is highly attractive, but because of the nature of its composition, it is difficult to mount panels of such material to metal structural substrates without requiring the use of molding or fasteners which extend completely through the panel and thus are unsightly and detract from its appearance. Additionally such panels are translucent and ideal fasteners should not invade the translucency of the solid color product. The solid color preservation is a particular problem where thin panels of, for example, ¼ inch thickness are used as is customary in the art.

The present invention relates to a mechanical system for fastening simulated marble panels such as CORIAN® sheeting to metal or other structural substrates. The invention is particularly useful and fills a distinct need in that there are no acceptable adhesives presently on the market to effect a permanent bonding of material such as CORIAN® to metal. The invention, however, insures the successful application of such sheeting to substrates for interior or exterior vertical or inverted horizontal uses. Thus, the invention makes possible, the panelization of simulated marble sheeting such as CORIAN® for the building industry.

Figure 3:
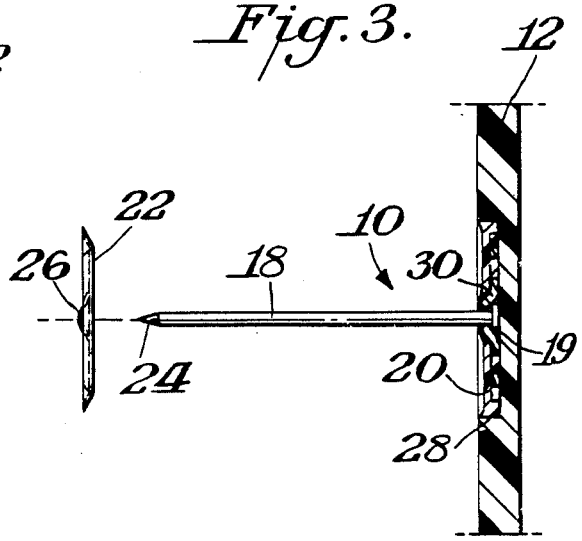
FIG. 3 is a cross-sectional view taken through FIG. 2 along the line 3—3.

The mechanical system of this invention involves embedding a modified insulation hanger or anchor 10 into a shallow pocket or recess 28 such as illustrated in FIG. 3. Pocket or recess 28 would be, for example, milled into the back side of the simulated marble sheeting 12 and filled with any suitable bonding agent such as DuPont CORIAN® joint compound. Anchor or hanger 10 is in the form of a pin or shaft 18 having a head or flange 19 at one end thereof to which is secured a perforated base or plate 20. When the hanger or anchor 10 is inserted in recess 28 with plate 20 exposed below the outer surface of the panel 12 the perforated base or plate 20 becomes inundated with the joint bonding agent 30 which flows into recess 20 to fill all of the perforations in plate 20 and fill the remainder of recess 28 while covering plate 20. The excess bonding agent may be troweled away to provide a flush fashion. Alternatively, the adhesive surface may be slightly below the panel surface.

A feature of the invention is a different approach in the type of bonding agent. The bonding agent is a methyl methacrylate monomer added to the CORIAN® surface and polymerized. As a result a surface interaction occurs whereby the adjoining surface of the CORIAN® is dissolved while the methyl methacrylate monomer is being catalyzed and polymerized. The result is a monolithic or integral bond of the bonding agent and CORIAN® panel. This bonding is quite different from a standard adhesive type system where one type of compound forms a surface adhesion to another type of compound. With the invention the result is theoretically uniform and should achieve theoretically the same strength as the virgin material. Thus in the anchoring of mechanical fasteners 10 to a CORIAN® substrate it is important to realize that the metal base 20 of the anchorage 10 is not adhesively fastened to the CORIAN®, rather it is encased in an embedment of monolithic structure. This is accomplished by using a material as the bonding agent which is essentially the same as the CORIAN® so that an integral bond results. The anchor 10 is embedded even where shallow recesses are used. The cured joint of the bonding agent to the panel thereby yields a theoretically, chemically monolithic embedment for the base 20 of anchor or hanger 10 with tremendous tensile resistance. The result is a firmly embedded galvanized pin 18 projecting perpendicular to the back surface of the panel 12.

A one-way locking tab or retainer plate 22 is applied to pin 18 after the pin 18 penetrates a predrilled substrate creating a permanent fastening point for the panel 12. The predrilled substrate holes are preferably two to three pin diameters larger than the diameter of pin 18 to allow for differential expansion of the CORIAN® and the substrate under exterior conditions. When combined with a good structural silicon adhesive such as Dow #790 or 795 a particularly effective fastening results.

The insulation hanger or anchor 10 is preferably made of a six to eight penny galvanized pin 18 pointed at one end 24 and peaned or rivet formed into a small perforated piece of galvanized sheet metal which forms base or plate 20. Plate 20 is preferably a circular metal disc. Base or plate 20 may for example be of approximately 28–30 gauge thickness. Base or plate 20 is preferably of one inch in diameter with each perforation being about 3 mm with about 1–1½ mm average tangential separation to reduce the surface area of the base 20. This reduction greatly strengthens the permeating fashion of the joint compound allowing for extremely shallow pocketing of the anchor 10 into the panel 12. It also reduces radial and transplanar rupturing of the organic matrix by the metal base 20 due to changes in thermal expansion coefficients of the CORIAN® versus the metal base 20. This is a particularly unique feature in CORIAN® systems which allows the application of, for example, one-fourth inch thick translucent CORIAN® to be used without sacrificing structural integrity or visual irregularities in the installed product.

Figure 1:
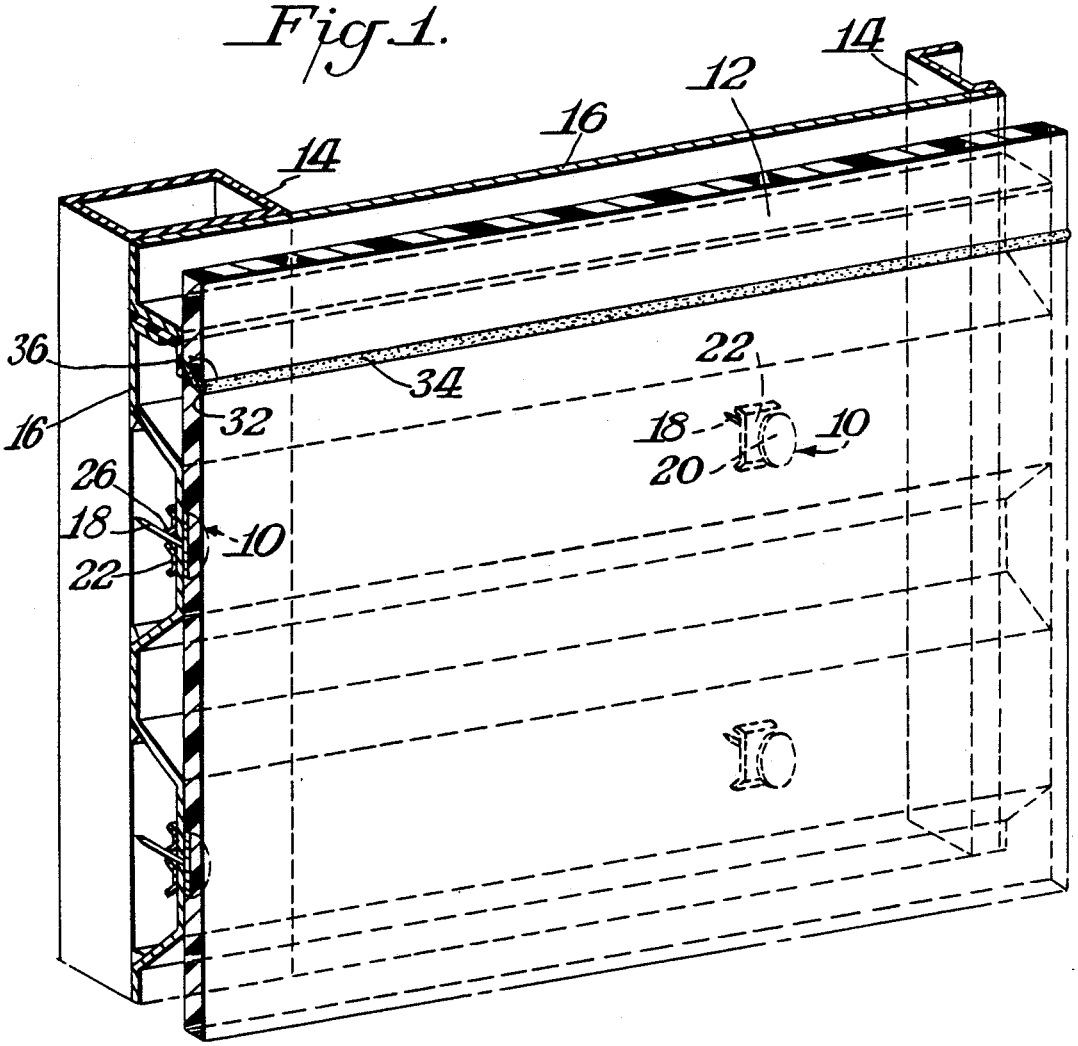
FIG. 1 is a perspective view, partly in section, of an anchor member used for mounting a simulated marble panel to a metal structural substrate.
Figure 2:
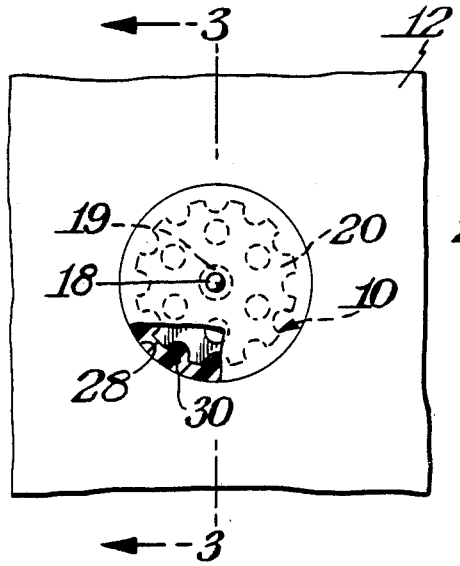
FIG. 2 is a rear elevation view, partly in section, of the anchor member of FIG. 1.

FIG. 1 illustrates one practice of the invention wherein the panel 12 is mounted to a structural substrate. In the illustrated embodiment, the structural substrate comprises spaced metal studs 14 to which is secured corrugated metal sheet backer 16 secured to studs 14 in any suitable known manner such as by welding.

The CORIAN® panels are preferably beveled or mitred at junctions as indicated by the reference numeral 32, such as for example at a forty-five degree angle. This mitering serves to augment resistance to water penetration of the joints formed by the synthetic gasket material 34. The sealant 34 is applied on site between individually applied panels.

As previously indicated the back side or rear surface of panels 12 is formed with a plurality or pattern of recesses 28 into which is secured the base 20 of anchors 10. The pin 18 of each anchor 10 is inserted through predrilled holes in corrugated metal backer 16. Retainer plates 22 are mounted on pins 18. This is facilitated by the pointed end 24 of each pin functioning as a cam surface which slides through spring fingers 26 formed by radial slits in the retainer plates 26. As illustrated fingers 26 extend outwardly in a conical manner. The net result is to form a one-way locking tab with the corrugated backer 16 thus being sandwiched between the retainer plate 22 and the panel 12. If desired, a permanent securement of retainer plate 22 may be made in any suitable manner such as by spot welding the retainer plate 22 to pin 18 or to backer 16. A further alternative would be to provide a threaded outer surface on pin 18 and to form retainer plate 22 as an internally threaded lock nut which could be screwed onto the threaded pin while allowing for lateral expansion. A spot welding of an exaggerated conical locking tab would preferably be used on stacking panels. The spot welding of the conical locking tabs 26 prevents shear forces of the panels on stackable wall panels while allowing for expansion movement. The shear forces or settling on non-stacking curtain wall panels is arrested with projected base tabs or channels fixed to the substrate which rest on the band of vision panels below.

Two types of retaining tabs 22 are recommended for the CORIAN® panelization system. One is a standard relatively flat stamp conical or square tab, the other one is an exaggerated conical tab. The flat tab will prevent tensile movement of the CORIAN® panels. In all cases tensile movement is the force that should be resisted. In the case of curtain wall panelization whereby the CORIAN® seats on incorporated tabs or channels to arrest the effects of gravity, the main concern is shear stress and the flat standard tabs will suitably arrest tensile stress on the CORIAN®. In the case where the panels are stackable an exaggerated conical locking tab (i.e. one in which fingers 26 project outwardly a substantial distance) which will allow for more torsion in the anchorage pins. The exaggerated conical tabs are spot welded to the back of the corrugated substrates to allow for expansion movement, but not allow for an overabundance of shear movement of the CORIAN®.

Although plate 22 is preferably circular, the invention may be practiced with square or rectangular discs.

As can be appreciated the present invention thereby provides an effective manner of mounting simulated marble panels such as CORIAN® sheeting to a structural substrate without requiring unsightly molding or fastening devices which extend completely through the panels and without upsetting the solid color of the translucent panels.

What is claimed is:

1. In combination therewith, a simulated marble panel including a pattern of recesses, a structural substrate, a plurality of anchoring systems securing said panel to said substrate, each of said anchoring systems comprising an elongated pin having a remote end and a base end opposite therefrom, an anchor plate secured to said base end, said anchor plate being disposed against said panel, one of said anchor plates being in each of said recesses, on the side of said substrate opposite to said anchor plate, a retainer plate mounted on said pin and disposed against said substrate on said side of said substrate opposite said anchor plate to mount said anchoring system to said substrate, a bonding agent disposed over said anchor plate filling said perforations of said anchor plate and completely covering said anchor plate and filling each of said recesses, and said bonding agent being of similar composition to the material of said simulated marble panel to form a monolithic integral bond between said bonding agent and said simulated marble panel with said anchor plate completely embedded therebetween.

2. The combination of claim 1 wherein said remote end of said pin is pointed, and said retainer plate having spring fingers in contact with said pin and being mounted for one-way movement toward said anchor plate.

3. The combination of claim 2 wherein retainer plate is mounted to said pin as a one-way locking tab, and said spring fingers being formed by radial slits with said spring fingers extending conically toward said pointed remote end of said pin.

4. The combination of claim 3 wherein said anchor plate is a circular disc.

5. The combination of claim 1 wherein said panel and said substrate are vertically mounted.

6. The combination of claim 1 wherein said simulated marble is alumina trihydrate in a polymethyl methacrylate, and said bonding agent is a methyl methacrylate monomer.

7. The combination of claim 1 wherein said simulated marble is CORIAN®.

8. The combination of claim 7 wherein said structural substrate is made of metal.

9. The combination of claim 1 wherein said simulated marble is CORIAN® which is translucent and about one-quarter inch thick.

10. The combination of claim 9 wherein said panel and said substrate are vertically mounted.

* * * * *